US009653226B2

(12) United States Patent
Ikeda et al.

(10) Patent No.: US 9,653,226 B2
(45) Date of Patent: May 16, 2017

(54) POWER SHUTOFF DEVICE

(75) Inventors: Tomohiro Ikeda, Shizuoka-ken (JP); Ryuta Takishita, Shizuoka-ken (JP); Kouichiro Mochizuki, Shizuoka-ken (JP); Teruhiko Ohike, Shizuoka-ken (JP); Sho Nogashira, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/589,536

(22) Filed: Aug. 20, 2012

(65) Prior Publication Data

US 2013/0049920 A1 Feb. 28, 2013

(30) Foreign Application Priority Data

Aug. 22, 2011 (JP) ..... P2011-180252

(51) Int. Cl.

| | |
|---|---|
| ***H01H 85/50*** | (2006.01) |
| ***H01H 9/08*** | (2006.01) |
| *H01H 9/10* | (2006.01) |
| *H01H 85/20* | (2006.01) |

(52) U.S. Cl.

CPC ..... *H01H 9/085* (2013.01); *H01H 9/10* (2013.01); *H01H 85/205* (2013.01)

(58) Field of Classification Search

CPC ..... H01H 9/085; H01H 85/205; H01H 9/10
USPC ..... 337/187
See application file for complete search history.

(56) References Cited

U.S. PATENT DOCUMENTS

| | | | | |
|---|---|---|---|---|
| 5,831,228 | A * | 11/1998 | Kuki | H01H 3/02 200/16 E |
| 6,333,845 | B1 * | 12/2001 | Hashizawa et al. | 361/642 |
| 6,333,846 | B1 * | 12/2001 | Hashizawa | H01H 9/085 337/198 |
| 6,396,380 | B1 * | 5/2002 | Girke et al. | 337/189 |

(Continued)

FOREIGN PATENT DOCUMENTS

| | | |
|---|---|---|
| JP | S53-50450 | 10/1976 |
| JP | H09-223439 | 8/1997 |

(Continued)

OTHER PUBLICATIONS

Notification of Reasons for Refusal for Japanese Patent Application No. 2011-180252 dated Jun. 23, 2015, and English translation thereof.

*Primary Examiner* — Anatoly Vortman
(74) *Attorney, Agent, or Firm* — Finnegan, Henderson, Farabow, Garrett & Dunner, L.L.P.

(57) ABSTRACT

A power shutoff device includes: a fuse to shut off conduction between the input portion connected to a power source side and the output portion connected to a load side; a box having a first face side with the input portion, the output portion, and the fuse to be assembled thereon; and a lock portion to fix one of the input portion and the output portion to the box. The one of the input portion and the output portion is integrally provided to the fuse. The other of the input portion and the output portion includes a first terminal portion integrally provided to the fuse and fixed to the box via a bolt, and a second terminal portion separately provided from the fuse and connected to the first terminal portion via a connecting member being attachable and detachable on a second face side of the box.

3 Claims, 5 Drawing Sheets

(56) References Cited

U.S. PATENT DOCUMENTS

| | | | | |
|---|---|---|---|---|
| 6,407,656 | B1 * | 6/2002 | Konda | H01H 1/365 337/186 |
| 6,459,354 | B2 * | 10/2002 | Konda | H01H 9/085 200/17 R |
| 6,580,040 | B2 * | 6/2003 | Konda | H01H 9/085 200/16 E |
| 2007/0241857 | A1 * | 10/2007 | Ito et al. | 337/187 |
| 2008/0185276 | A1 | 8/2008 | Matsunaga et al. | |

FOREIGN PATENT DOCUMENTS

| | | |
|---|---|---|
| JP | 2000-207975 | 7/2000 |
| JP | 2008-176969 | 7/2008 |

* cited by examiner

POWER SHUTOFF DEVICE

CROSS REFERENCE TO RELATED APPLICATION

This application is based upon and claims the benefit of priority from the prior Japanese Patent Application No. 2011-180252, filed on Aug. 22, 2011, the entire contents of which are incorporated herein by reference.

BACKGROUND OF THE INVENTION

1. Field of the Invention

The present invention relates to a power shutoff device disposed between a power source side and a load side.

2. Description of the Related Art

Japanese Patent Unexamined Publication No. 2008-176969 proposes a power shutoff device provided with an input portion connected to a power source side, a pair of switch terminals as an output portion connected to a load side, and a fuse disposed between the pair of switch terminals and capable of shutting the conduction between the pair of switch terminals by an overcurrent.

This power shutoff device is provided with a first housing having a pair of main circuit terminals connected with the pair of switch terminals and a second housing having the pair of switch terminals and the fuse and capable of being mated with the first housing via a lever.

With the above power shutoff device, in order to secure safety in operations such as maintenance, conduction between the power source side and the load side is shut off by dismounting the second housing from the first housing.

SUMMARY OF THE INVENTION

However, in the above power shutoff device, for shutting off the conduction between the power source side and the load side, it is necessary to dismount, from the first housing, the second housing having the pair of switch terminals and the fuse. Thus, after the second housing is dismounted from the first housing, it is necessary to control at least two members, that is, the second housing and the fuse, resulting in lowering of the assembly workability.

The fuse is fixed to the first housing by a bolt which fixes the pair of switch terminals. Thus, when an operator simply tries to mount the fuse to the first housing, for example, after the first housing is assembled to a counterpart mechanism such as an in-vehicle part, the bolt is removed and external terminals connected to the power source side and load side are disposed at the respective input portion and output portion of the fuse, and then it is necessary to fix again, by the bolt, the pair of switch terminals together with the external terminals. For this reason, the number of assembling man hours or the number of parts will be increased, thus causing a possibility of further lowering the assembly workability.

For preventing the lowering of the assembly workability, it is conceivable to abolish the bolt which fixes the pair of switch terminals. However, in this case, it is necessary to provide a lock mechanism for locking the fuse to the first housing and to assemble the first housing with the fuse locked to the first housing. The above structure for locking the fuse by the lock mechanism may cause a possibility that the fuse is unlocked when conveying or assembling the first housing to thereby cause the fuse to drop off from the first housing.

It is an object of the present invention to provide a power shutoff device capable of preventing a fuse from dropping off from a box and capable of improving assembly workability.

An aspect of the present invention is a power shutoff device including: an input portion connected to a power source side; an output portion connected to a load side; a fuse disposed between the input portion and the output portion and configured to shut off conduction between the input portion and the output portion by an overcurrent; a box having a first face side with the input portion, the output portion, and the fuse to be assembled on the first face side; a lock portion provided at the box and configured to fix one of the input portion and the output portion to the box; and a bolt. The one of the input portion and the output portion is integrally provided to the fuse. The other of the input portion and the output portion includes a first terminal portion integrally provided to the fuse and fixed to the box via the bolt, and a second terminal portion separately provided from the fuse and connected to the first terminal portion via a connecting member being attachable and detachable on a second face side of the box.

According to the aspect, the power shutoff device has such a structure that the other of the input portion and the output portion includes the first terminal portion provided to be integrated with the fuse and the second terminal portion provided to be separated from the fuse. Thus, a bolt for fixing the fuse to the box does not need to be tightened to the second terminal portion provided to be separated from the fuse.

Thus, connecting an external terminal on the power source side or load side to the second terminal portion in the process of assembling the box to a counterpart mechanism is sufficient, eliminating the need of carrying out dismounting of the bolt a plurality of times. By this, it is possible to improve the assembly workability of the power shutoff device.

Further, the first terminal portion and the second terminal portion are connected with each other via the connecting member which is attachable and detachable on the second face side of the box. Thus, when the conduction between the power source side and the load side is to be shut off, dismounting only the connecting member from the box is sufficient, leaving only the connecting member that needs to be managed after the dismounting, thus making it possible to improve the assembly workability.

The first terminal portion provided to be integrated with the fuse is fixed to the box via the bolt and one of the input portion and the output portion provided to be integrated with the fuse is fixed to the box via the lock portion provided at the box. Thus, the fuse can be fixed to the box by the bolt and the lock portion, thereby making it possible to allow the bolt to prevent the fuse from dropping off from the box even if the lock portion is unlocked during conveyance or assembly.

Thus, according to the aspect, the attachable/detachable connecting member connects the first terminal portion with the second terminal portion, and the bolt and the lock portion fix the fuse to the box, thus making it possible to prevent the fuse from dropping off from the box and to improve the assembly workability.

The first face side of the box may be positioned downward in a direction of gravitational force with the power shutoff device assembled, and the lock portion may support a lower face of the one of the input portion and the output portion.

According to the above structure, the first face side of the box is positioned downward in the direction of gravitational force. Thus, attaching and detaching of the connecting member which is attached and detached at the second face side of the box can be carried out at the upward position in the direction of gravitational force, thus making it possible to improve the operability of attaching and detaching the connecting member.

Further, the lock portion supports the lower face of one of the input portion and the output portion. Thus, it is possible to prevent the fuse from dropping off from the box by the gravitational force and it is possible to relieve a load applied to the first terminal portion fixed by the bolt.

The power shutoff device may further include a lever for attaching the connecting member to the box and detaching the connecting member from the box.

According to the above structure, the connecting member is attached to the box or detached from the box via the lever. Thus, it is possible to relieve an attaching/detaching operational force of the connecting member, thus making it possible to improve the assembly workability of the connecting member to the box.

The embodiment of the present invention brings about an effect of providing a power shutoff device capable of preventing dropping off of a fuse from a box and improving assembly workability.

DETAILED DESCRIPTION OF THE EMBODIMENT

Figure 1:
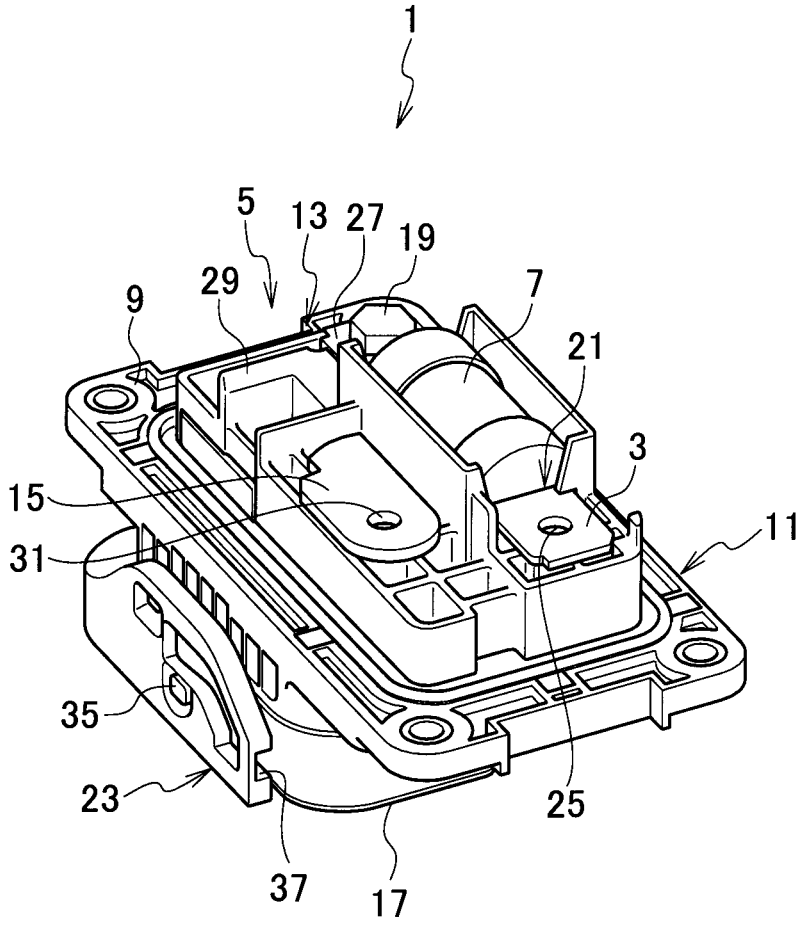
FIG. 1 is a perspective view of a power shutoff device according to an embodiment of the present invention.
Figure 2:
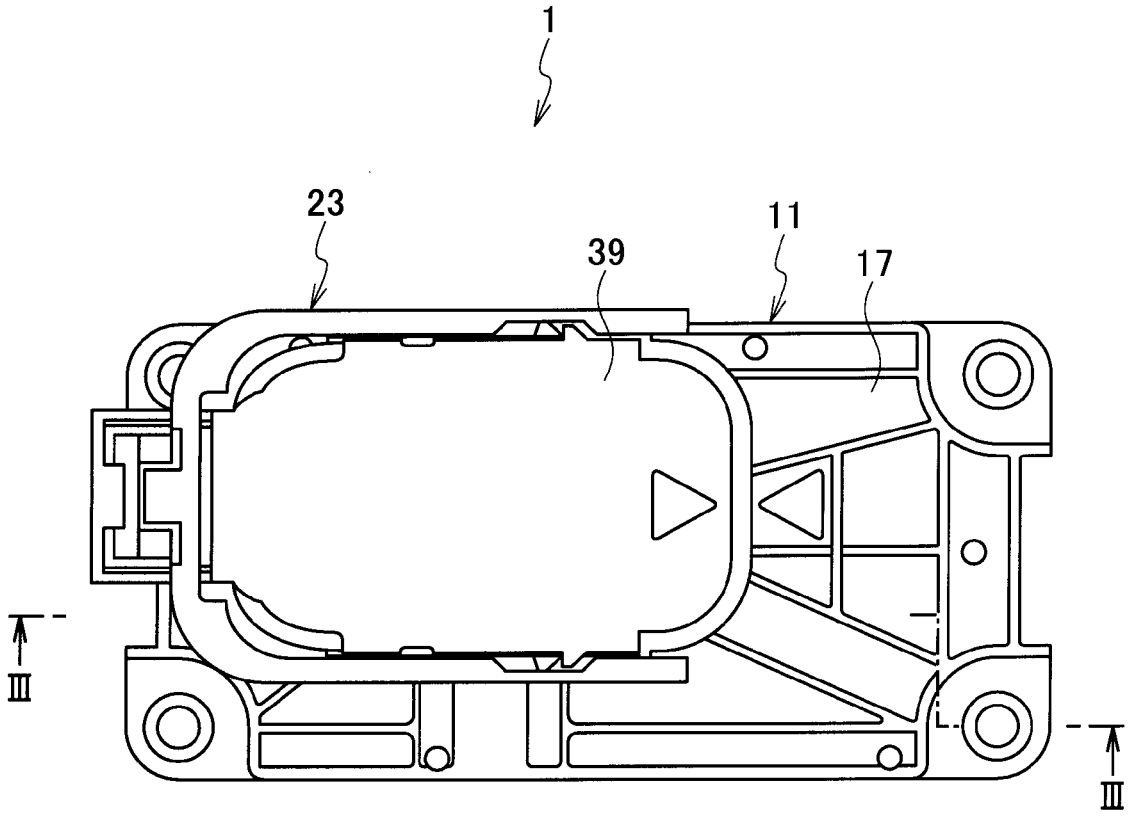
FIG. 2 is a top view of the power shutoff device according to the embodiment of the present invention.
Figure 3:
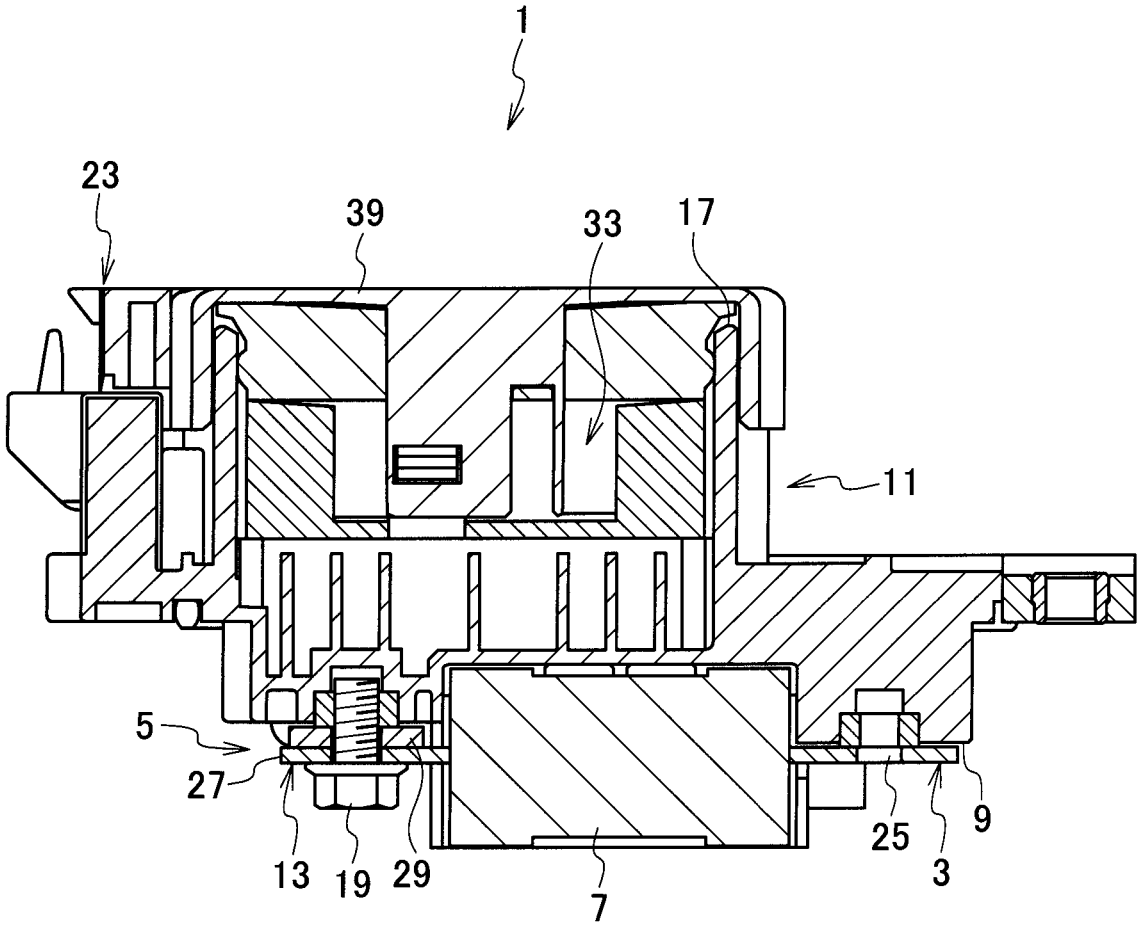
FIG. 3 is a cross sectional view taken along the line III-III in FIG. 2.
Figure 4:
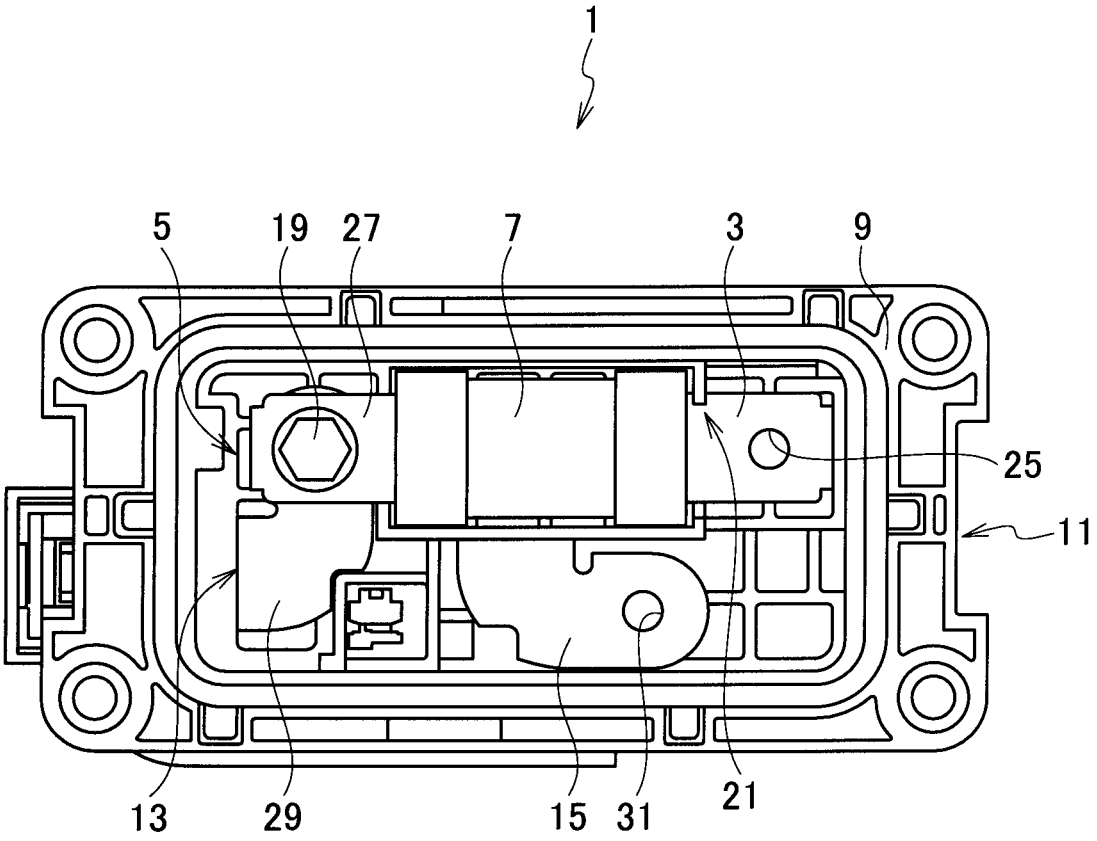
FIG. 4 is a bottom view of the power shutoff device according to the embodiment of the present invention.
Figure 5:
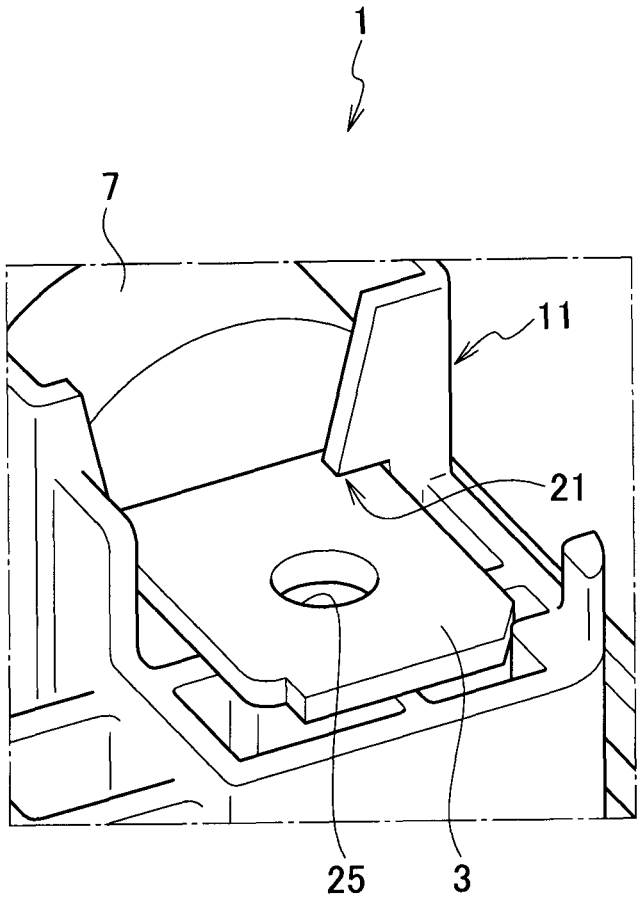
FIG. 5 is an enlarged view of essential parts of the power shutoff device according to the embodiment of the present invention.

Referring to FIG. 1 to FIG. 5, a power shutoff device according to an embodiment of the present invention will be set forth.

A power shutoff device 1 according to the embodiment is provided with an input portion 3 connected to a power source side, an output portion 5 connected to a load side, a fuse 7 disposed between the input portion 3 and the output portion 5 and configured to shut off the conduction between the input portion 3 and the output portion 5 by an overcurrent, and a box 11 having a first face 9 side with the input portion 3, the output portion 5 and the fuse 7 assembled to the first face side.

The input portion 3 is provided to be integrated with the fuse 7. The output portion 5 includes a first terminal portion 13 provided to be integrated with the fuse 7 and a second terminal portion 15 separated from the fuse 7. The first terminal portion 13 and the second terminal portion 15 are connected with each other via a connecting member (not illustrated) which is attachable and detachable on a second face 17 side of the box 11.

The first terminal portion 13 is fixed to the box 11 via a bolt 19. The input portion 3 is fixed to the box 11 via a lock portion 21 provided at the box 11.

The first face 9 side of the box 11 is positioned downward in the direction of gravitational force, and the lock portion 21 supports a lower face of the input portion 3.

The connecting member is attached to the box 11 or detached from the box 11 via a lever 23.

As shown in FIG. 1 to FIG. 5, the power shutoff device 1 is disposed between the power source side and the load side, and is provided with the input portion 3, the output portion 5, the fuse 7 and the box 11.

The input portion 3 is made of a conductive material and is in a form of a thin plate. The input portion 3 has an edge portion on the fuse 7 side thereof which is provided to be integrated with the fuse 7, thereby making the input portion 3 conductive with the fuse 7. The input portion 3 is formed with an input hole portion 25, and an external terminal (not illustrated) such as a terminal or a harness connected to the power source side is fixed to the input hole portion 25 by a fixing member such as a bolt.

The output portion 5 includes the first terminal portion 13 and the second terminal portion 15. The first terminal portion 13 is provided with a coupling portion 27 and a connecting portion 29. The coupling portion 27 is made of a conductive material and is made in a form of a thin plate. The coupling portion 27 has an edge portion on the fuse 7 side thereof which is provided to be integrated with the fuse 7, thereby making the first terminal portion 13 conductive with the fuse 7. The connecting portion 29 is fixed to the coupling portion 27 by the bolt 19.

The connecting portion 29 is made of a conductive material and is formed into an alphabetical L extending from the first face 9 side of the box 11 toward the second face 17 side of the box 11. The connecting portion 29 has a first end side thereof conducive with the coupling portion 27 and a second end side thereof disposed in the box 11.

The second terminal portion 15 is made of a conductive material and is formed into an alphabetical L extending from the first face 9 side of the box 11 to the second face 17 side of the box 11. The second terminal portion 15 is provided to be separated from the fuse 7 and is not conductive with the fuse 7. The second terminal portion 15 is formed with an output hole portion 31, and an external terminal (not illustrated) such as a terminal or a harness connected to the load side is fixed to the output hole portion 31 by a fixing member such as a bolt.

The above first terminal portion 13 (connecting portion 29) and the above second terminal portion 15 each have an edge portion extending toward the second face 17 side of the box 11 and the edge portions are disposed within a mating portion 33 of the box 11. The first terminal portion 13 and the second terminal portion 15 are connected with each other by the connecting member mated with the box 11.

The connecting member is mated in the mating portion 33 of the box 11 where the first terminal portion 13 and the second terminal portion 15 are disposed. When being mated in the mating portion 33 of the box 11, this connecting member is connected with the first terminal portion 13 and the second terminal portion 15, thereby making the first terminal portion 13 and the second terminal portion 15 conductive with each other via the connecting member. The conduction between the first terminal portion 13 and the second terminal portion 15 connects the input portion 3 with the output portion 5 via the fuse 7, thereby connecting the power source side with the load side. Dismounting the connecting member from the mating portion 33 of the box 11 shuts off the conduction between the first terminal portion 13 and the second terminal portion 15, thus shutting off the conduction between the power source side and the load side.

The attaching/detaching operation of the connecting member is performed by the lever 23.

The lever 23 is so disposed as to rotate via spindles 35 (only one side shown) disposed at both sides of the box 11, and cam grooves 37 (only one side shown) are disposed at both side walls. When being positioned above the box 11, the lever 23 allows the cam groove 37 to be engaged with a cam pin disposed at the connecting member and a leverage operation by rotating the lever 23 downward mates the connecting member with the mating portion 33 of the box 11. For releasing the mating between the connector member and the box 11, rotating the lever 23 upward can dismount the connecting member. The fuse 7 is disposed between the input portion 3 and the output portion 5 between which the conduction is on and off by attaching and detaching of the connecting member.

The fuse 7 is in a form of a rectangle, and has a first end side thereof in the longitudinal direction provided to be integrated with the input portion 3 and a second end side thereof in the longitudinal direction provided to be integrated with the coupling portion 27 which is a part of the first terminal portion 13 of the output portion 5. The fuse 7 is disposed between the input portion 3 and the output portion 5, that is, between the power source side and the load side, and flowing of the overcurrent in the fuse 7 shuts off the conduction between the power source side and the load side. The above fuse 7 is fixed to the first face 9 side of the box 11 via the input portion 3 and the coupling portion 27.

The box 11 is made of an insulating material such as synthetic resin and is positioned between the power source side and the load side when installed to a vehicle. In the state where the box 11 is installed to the vehicle, the first face 9 side on which the fuse 7 is disposed is positioned downward in the gravitation direction while the second face 17 side on which an opening of the mating portion 33 mated with the connecting member is disposed is positioned upward in the direction of gravitational force. On the second face 17 side of the box 11, a cover 39 for blocking the mating portion 33 is provided in such a manner as to open and close, and protects the connecting member. The fuse 7 disposed on the first face 9 side as a rear face of the box 11 can be prevented, by the bolt 19 and the lock portion 21, from dropping off from the box 11.

Tightening the bolt 19 to the box 11 accomplishes the conduction between the coupling portion 27 and the connecting portion 29 of the first terminal portion 13 and fixes the coupling portion 27 and connection portion 29 to the box 11. The bolt 19 allows the second end side of the fuse 7 to be fixed to the box 11, thus preventing the fuse 7 from dropping off from the box 11. The first end side of the fuse 7 is fixed by the lock portion 21.

The lock portion 21 extends in a form of an alphabetical L outwardly from the first face 9 side of the box 11. The lock portion 21 supports the lower face of the input portion 3 and allows the first end side of the fuse 7 to be fixed to the box 11, thus preventing the fuse 7 from dropping off from the box 11. Though being disposed at the fuse 7 side of the input portion 3, the lock portion 21 may be disposed in any positions as long as the lock portion 21 can support the lower face of the input portion 3, and the lock portion 21 may have any configuration.

As set forth above, the fuse 7 is fixed to the box 11 by the bolt 19 and the lock portion 21, thus preventing the fuse 7 from dropping off from the box 11. Thus, in a state before the power shutoff device 1 is installed to the vehicle, the power shutoff device 1 can be easily conveyed alone, thus making it possible to improve the conveyance efficiency of the power shutoff device 1.

When the power shutoff device 1 is to be installed to the vehicle, the external terminal connected to the load side does not need to be connected to the coupling portion 27 of the first terminal portion 13, eliminating the need of dismounting the bolt 19. In addition, since each of the input portion 3 and the second terminal portion 15 is free of a bolt, the external terminals connected to the power source side and load side can be directly connected to the respective input hole portion 25 and output hole portion 31 simultaneously with the installing operation, thereby making it possible to improve the installation efficiency of the power shutoff device 1 to the vehicle.

In the above power shutoff device 1, the output portion 5 includes the first terminal portion 13 provided to be integrated with the fuse 7 and the second terminal portion 15 provided to be separated from the fuse 7. Thus, a bolt for fixing the fuse 7 to the box 11 does not need to be tightened to the second terminal portion 15 provided to be separated from the fuse 7.

Thus, connecting the external terminal on the load side to the second terminal portion 15 in the process of assembling the box 11 to the counterpart mechanism is sufficient, eliminating the need of carrying out dismounting of the bolt a plurality of times, thus making it possible to improve the assembly workability of the power shutoff device 1.

The first terminal portion 13 and the second terminal portion 15 are connected with each other via the connecting member which is attachable and detachable on the second face 17 side of the box 11. Thus, when the conduction between the power source side and the load side is to be shut off, dismounting only the connecting member from the box 11 is sufficient, leaving only the connecting member that needs to be managed after the dismounting, thus making it possible to improve the assembly workability.

The first terminal portion 13 provided to be integrated with the fuse 7 is fixed to the box 11 via the bolt 19 and the input portion 3 provided to be integrated with the fuse 7 is fixed to the box 11 via the lock portion 21 provided at the box 11. Thus, the fuse 7 can be fixed to the box 11 by the bolt 19 and the lock portion 21, thereby making it possible to allow the bolt 19 to prevent the fuse 7 from dropping off from the box 11 even if the lock portion 21 is unlocked during conveyance or assembly.

Thus, according to the above power shutoff device 1, the attachable/detachable connecting member connects the first terminal portion 13 with the second terminal portion 15, and the bolt 19 and the lock portion 21 fix the fuse 7 to the box 11, thus making it possible to prevent the fuse 7 from dropping off from the box 11 and improve the assembly workability.

The first face 9 side of the box 11 is positioned downward in the direction of gravitational force. Thus, attaching and detaching of the connecting member which is attached and detached at the second face 17 side of the box 11 can be carried out at the upward position in the direction of gravitational force, thus making it possible to improve the operability of attaching and detaching the connecting member.

The lock portion 21 supports the lower face of the input portion 3. Thus, it is possible to prevent the fuse 7 from dropping off from the box 11 by the gravitational force and it is possible to relieve a load applied to the first terminal portion 13 fixed by the bolt 19.

The connecting member is attached to the box 11 or detached from the box 11 via the lever 23. Thus, it is possible to relieve an attaching/detaching operational force of the connecting member, thus making it possible to improve the assembly workability of the connecting member to the box 11.

With the power shutoff device 1 according to the present invention, it is so configured that the output portion connected to the load side includes the first terminal portion 13 and the second terminal portion 15. However, the present invention is not limited to this configuration. It may be so configured that the input portion connected to the power source side includes a first terminal portion and a second terminal portion.

In this case, it is sufficient to make such that the first terminal portion of the input portion provided to be integrated with the fuse 7 is fixed to the box by a bolt and the output portion provided to be integrated with the fuse 7 is fixed to the box by the lock portion.

The first terminal portion includes two members, that is, the coupling portion 27 and the connecting portion 29. However, it is not limited to this configuration, and the first terminal portion may include one member having the coupling portion 27 continuous with the connecting portion 29.

Although the embodiment of the present invention has been described above, the invention is not limited to the above embodiment, and various modifications are possible.

What is claimed is:

1. A power shutoff device comprising:

an input portion connected to a power source side;

an output portion connected to a load side;

a fuse disposed between the input portion and the output portion, wherein the fuse shuts off conduction between the input portion and the output portion by an overcurrent;

a box having a first face side with the input portion, the output portion, and the fuse assembled on the first face side;

a lock portion provided at the box, wherein the lock portion fixes one of the input portion and the output portion to the box; and a bolt, wherein the one of the input portion and the output portion is integrally provided to the fuse, wherein the other of the input portion and the output portion comprises a first terminal portion integrally provided to the fuse and fixed to the box via the bolt, and a second terminal portion separately provided from the fuse, wherein the first terminal portion and the second terminal portion are connected with each other by a connecting member which is attachable and detachable on a second face side of the box, and wherein the second face side of the box is located in a reverse side of the first face side of the box.

2. The power shutoff device according to claim 1, wherein the first face side of the box is positioned downward in a direction of gravitational force with the power shutoff device assembled, and the lock portion supports a lower face of the one of the input portion and the output portion.

3. The power shutoff device according to claim 1, further comprising a lever for attaching the connecting member to the box and detaching the connecting member from the box.

* * * * *